US007927135B1

(12) United States Patent
Wlos

(10) Patent No.: US 7,927,135 B1
(45) Date of Patent: Apr. 19, 2011

(54) COAXIAL CONNECTOR WITH A COUPLING BODY WITH GRIP FINGERS ENGAGING A WEDGE OF A STABILIZING BODY

(75) Inventor: James Wlos, Crete, IL (US)

(73) Assignee: Andrew LLC, Hickory, NC (US)

( * ) Notice: Subject to any disclaimer, the term of this patent is extended or adjusted under 35 U.S.C. 154(b) by 0 days.

(21) Appl. No.: 12/853,863

(22) Filed: Aug. 10, 2010

(51) Int. Cl.
*H01R 9/05* (2006.01)

(52) U.S. Cl. ..... 439/584

(58) Field of Classification Search ..... 439/578–585, 439/775, 429; 29/828, 869
See application file for complete search history.

(56) References Cited

U.S. PATENT DOCUMENTS

| | | | | |
|---|---|---|---|---|
| 4,046,451 | A * | 9/1977 | Juds et al. | 439/583 |
| 4,995,832 | A | 2/1991 | Thommen et al. | |
| 5,322,454 | A | 6/1994 | Thommen | |
| 5,795,108 | A | 8/1998 | Lightle | |
| 6,210,222 | B1 | 4/2001 | Langham et al. | |
| 6,217,384 | B1 * | 4/2001 | Strasser et al. | 439/583 |
| 6,267,621 | B1 * | 7/2001 | Pitschi et al. | 439/584 |
| 6,471,545 | B1 | 10/2002 | Hosler, Sr. | |
| 7,077,699 | B2 | 7/2006 | Islam et al. | |
| 7,275,957 | B1 * | 10/2007 | Wlos et al. | 439/583 |
| 7,335,059 | B2 | 2/2008 | Vaccaro | |
| 7,347,729 | B2 | 3/2008 | Thomas et al. | |
| 7,435,135 | B2 * | 10/2008 | Wlos | 439/584 |
| 7,588,460 | B2 | 9/2009 | Malloy et al. | |
| 7,635,283 | B1 | 12/2009 | Islam | |
| 2007/0224880 | A1 * | 9/2007 | Wlos et al. | 439/578 |
| 2008/0194142 | A1 * | 8/2008 | Wlos | 439/584 |

FOREIGN PATENT DOCUMENTS

| | | |
|---|---|---|
| WO | 2004/055943 | 7/2004 |

* cited by examiner

*Primary Examiner* — Chandrika Prasad
(74) *Attorney, Agent, or Firm* — Babcock IP, PLLC

(57) ABSTRACT

A stabilizing coupling body assembly for a connector is provided with a monolithic coupling body dimensioned to couple with a cable end of a connector body of the connector. A plurality of grip fingers extends from a cable end of the coupling body, the grip fingers dimensioned for insertion within a bore of a stabilizing body. The stabilizing body is coupled to a cable end of the coupling body. A distal end of the grip fingers is proximate an annular wedge surface of the bore of the stabilizing body. The wedge surface is provided with a taper between a maximum diameter proximate a connector end and a minimum diameter proximate a cable end. The grip fingers are driven radially inward as the stabilizing body is advanced axially towards the coupling body. Methods of manufacture include forming elements of the coupling body assembly via injection molding and/or machining.

18 Claims, 7 Drawing Sheets

COAXIAL CONNECTOR WITH A COUPLING BODY WITH GRIP FINGERS ENGAGING A WEDGE OF A STABILIZING BODY

FIELD OF THE INVENTION

This invention relates to electrical cable connectors. More particularly, the invention relates to a connector stabilizing coupling body assembly for improving connector to cable retention and passive intermodulation distortion (PIM) electrical performance.

DESCRIPTION OF RELATED ART

Coaxial cable connectors are used, for example, in communication systems requiring a high level of precision and reliability.

To create a secure mechanical and optimized electrical interconnection between the cable and the connector, it is desirable to have generally uniform, circumferential contact between a leading edge of the coaxial cable outer conductor and the connector body. A flared end of the outer conductor may be clamped against an annular wedge surface of the connector body, via a coupling body. Representative of this technology is commonly owned U.S. Pat. No. 5,795,188 issued Aug. 18, 1998 to Harwath.

Alternative forms of connector to cable end electro-mechanical interconnection include various grip surface arrangements of the connector which contact and grip the inner and/or outer conductor of the coaxial cable.

During systems installation, rotational forces may be applied to the installed connector, for example as the attached coaxial cable is routed towards the next interconnection, maneuvered into position and/or curved for alignment with cable supports and/or retaining hangers. Rotation of the coaxial cable and coaxial connector with respect to each other may damage the connector, cable and/or the integrity of the cable/connector inter-connection. Further, once installed, twisting, bending and/or vibrations applied to the interconnection over time may degrade the connector to cable interconnection and/or introduce PIM.

Prior coaxial connectors typically utilize a coupling and/or back body as a driving means for clamp and/or grip interconnection mechanisms of the connector and/or as an ease of assembly means for enabling easy insertion of internal elements within the connector, such as seals and/or electrical contact elements. Coupling and/or back bodies may also include environmental seals compressed into a sealing configuration against the coaxial cable via a compression action with respect to the connector body. Representative of this technology is commonly owned U.S. Pat. No. 7,077,699 issued Jul. 18, 2006 to Islam et al. Although an environmental seal compressed to extend radially inward into contact with a jacket of a coaxial cable may provide a stabilizing effect upon the coaxial connector, the environmental seal is typically formed from an elastic material to enable an elastic sealing deformation contact against the jacket. Therefore, any stabilizing effect obtained from the environmental seal is limited.

Competition in the coaxial cable connector market has focused attention on improving electrical performance and minimization of overall costs, including materials costs, training requirements for installation personnel, reduction of dedicated installation tooling and the total number of required installation steps and/or operations.

Therefore, it is an object of the invention to provide a coupling and/or back body that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

The inventor has recognized that movement and/or skewing of alignment between the connector and coaxial cable may generate unacceptable levels of PIM and/or otherwise compromise the electromechanical interconnection, for example as contact surfaces shift relative to one another and/or less than uniform circumferential contact occurs between the electrical contacting elements of the connector and the inner and/or outer conductors.

Figure 1:
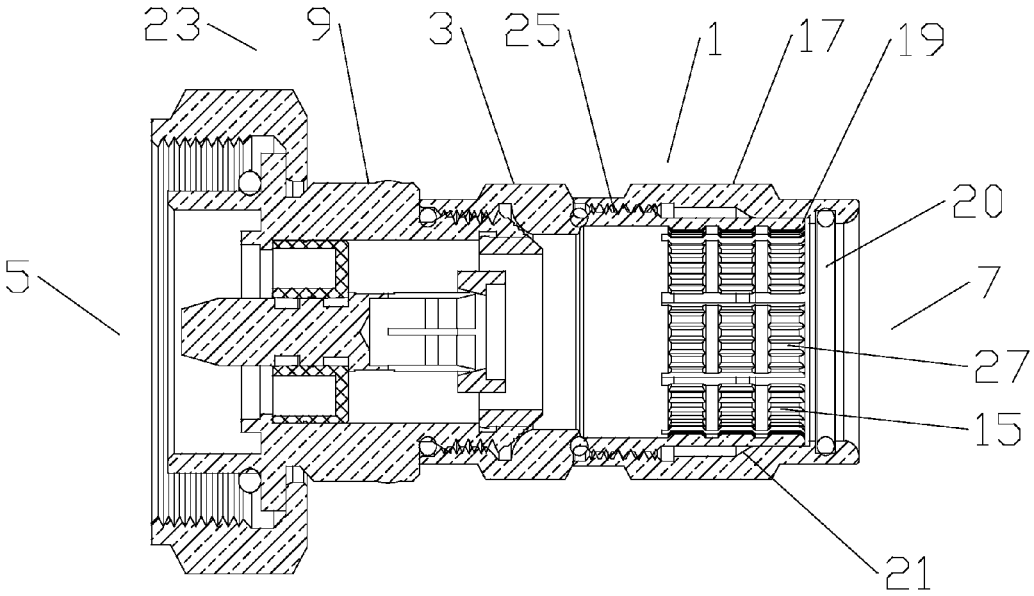
FIG. 1 is a schematic cross-section side view taken along line A-A of FIG. 2.
Figure 2:
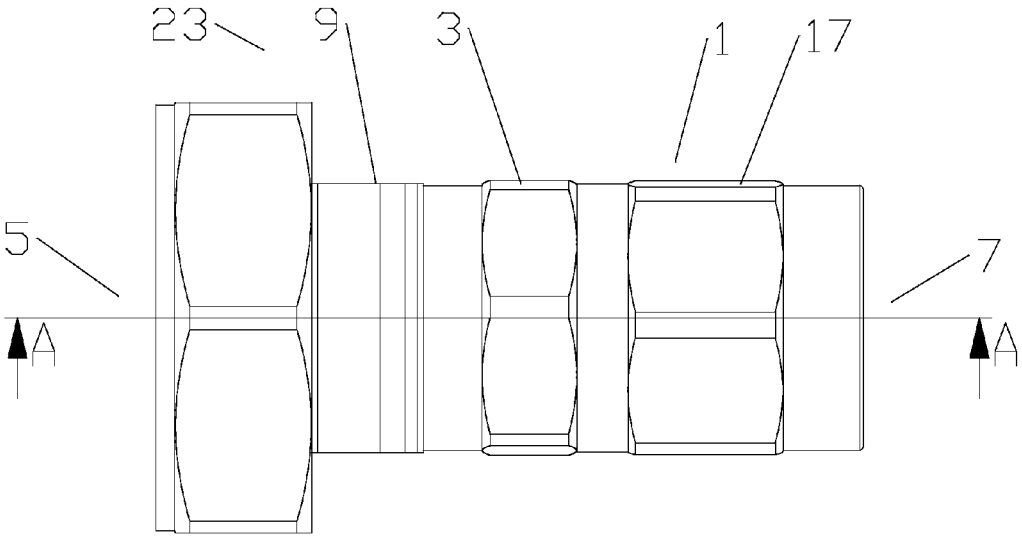
FIG. 2 is a schematic side view of an exemplary embodiment of a coupling body assembly shown mated with a coaxial connector, in a coaxial cable jacket gripping configuration.
Figure 3:
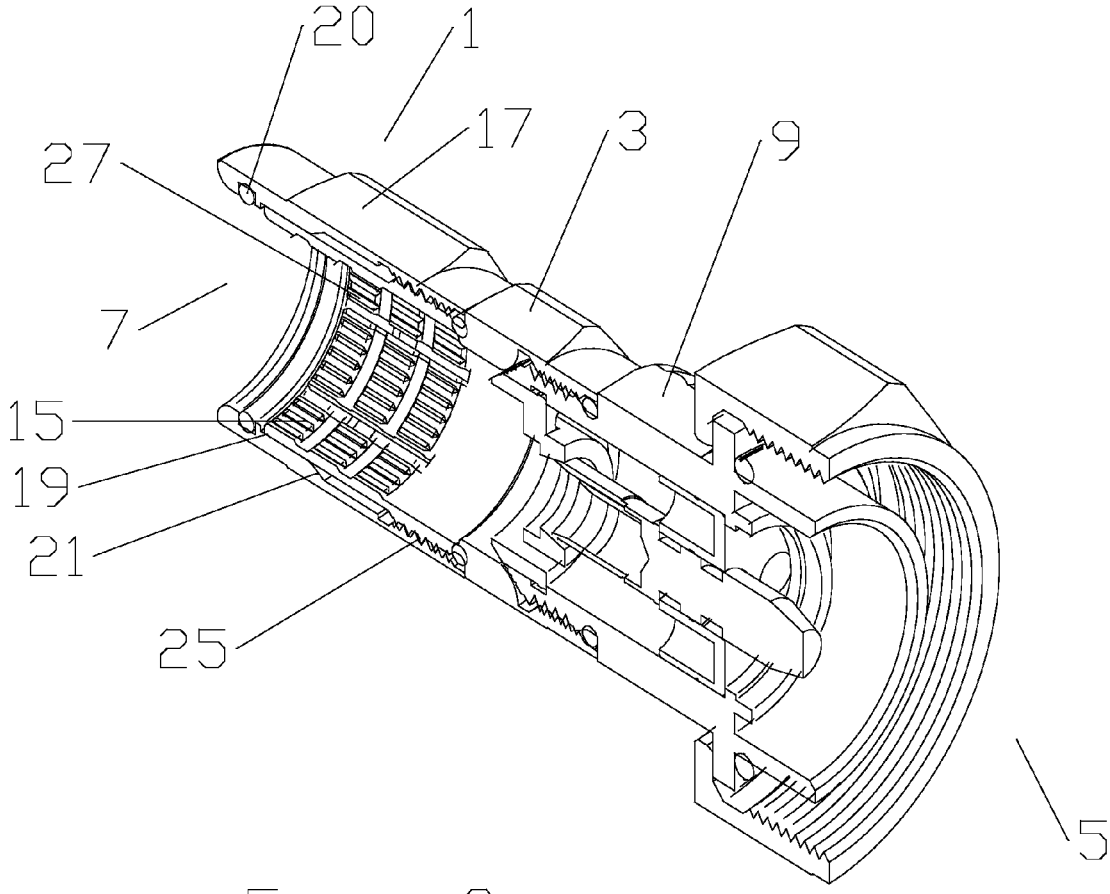
FIG. 3 is a angled isometric view of FIG. 1.

An exemplary embodiment of a coupling body assembly 1 with a connector to cable interconnection stabilizing functionality is demonstrated in FIGS. 1-12. As best shown in FIGS. 1-3, the coupling body assembly 1 includes a coupling body 3 dimensioned to couple at a connector end 5 of the coupling body 3 with a cable end 7 of a coaxial connector body 9.

One skilled in the art will appreciate that connector end 5 and cable end 7 are applied herein as identifiers for respective ends of both the overall assembly and also of discrete elements of the assembly described herein, to identify same and their respective interconnecting surfaces according to their alignment along a longitudinal axis of the coaxial connector between a connector end 5 and a cable end 7.

The coupling body 3 may be configured to perform connector functions in concert with the coaxial connector body 9 such as electro-mechanical interconnection with an outer conductor 11 of a coaxial cable 13 and also environmental sealing of the electromechanical interconnection, for example by elastomeric sealing gasket(s) 20 seated in a gasket shoulder or annular groove of the coupling body inner diameter and/or seated between the coupling body 3 and the connector body 9. Details of these functions and the associated structures of the coupling body 3 are dependent upon the type of coaxial connector 23 the coupling body assembly 1 is applied to, and as such are not further described in detail herein.

Environmental sealing of the interconnection between the coupling body 3 and the stabilizing body 17 may be, for example, via a sealing gasket 20 seated on an outer diameter of the coupling body 3, axially positioned to seal against an inner diameter of the stabilizing body 17 when the stabilizing body 17 is in a coupled position upon the coupling body 3.

Figure 8:
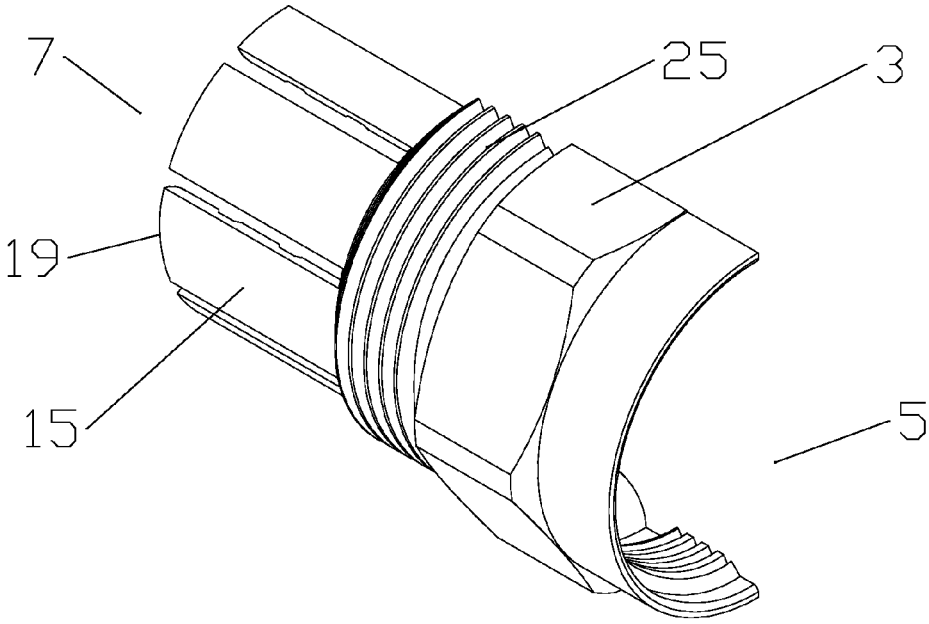
FIG. 8 is a schematic isometric cross-section outer view of the coupling body of FIG. 2.
Figure 9:
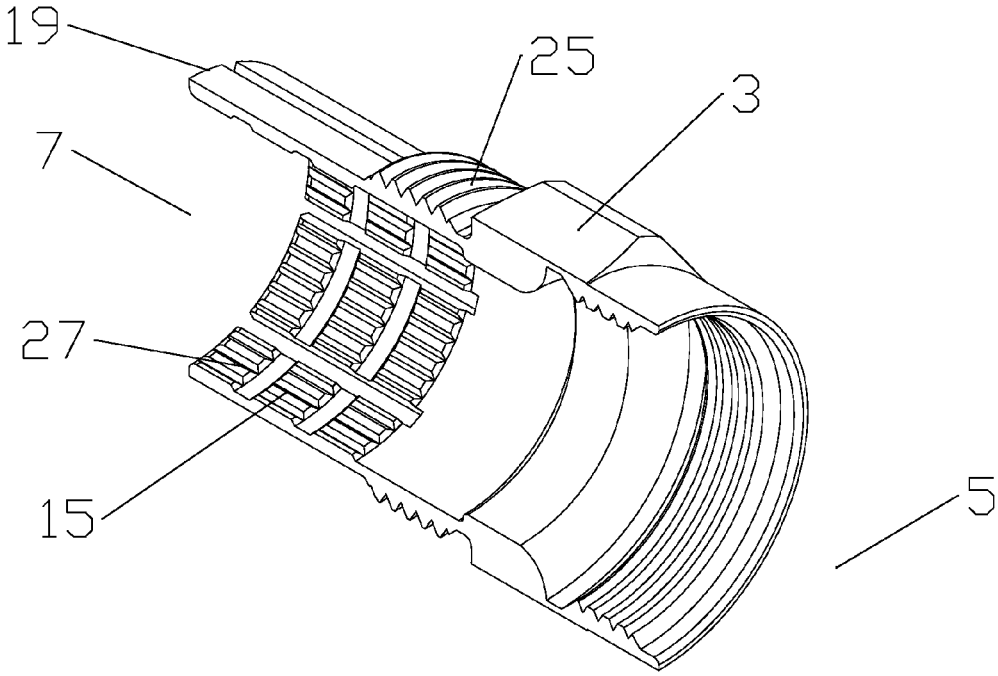
FIG. 9 is a schematic isometric cross-section inner view of the coupling body of FIG. 2.

As best shown in FIGS. 8 and 9, a plurality of grip fingers 15 extend from the cable end of the coupling body 3 within a bore of a stabilizing body 17 coupled to a cable end 7 of the coupling body 3. The grip fingers 15 may be formed in a circumferential arrangement around a bore of the coupling body 3 with an outward bias, dimensioned for fit within the bore of the stabilizing body 17 and also to enable insertion of the coaxial cable 13 there through with minimal interference prior to initiating stabilizing contact, for example during the interconnection of the coaxial connector 23 to the coaxial cable 13.

Because the grip fingers 15 are integral with the monolithic coupling body 3, manufacture and assembly are simplified as there are no additional separate components to verify/supply to the assembly area and any additional assembly steps required by such discrete elements are eliminated. Further, the coupling body assembly 1 configuration may be streamlined and materials savings realized as there is no need for additional coupling and/or retaining structures to receive, align and/or retain a separate grip finger element.

Figure 10:
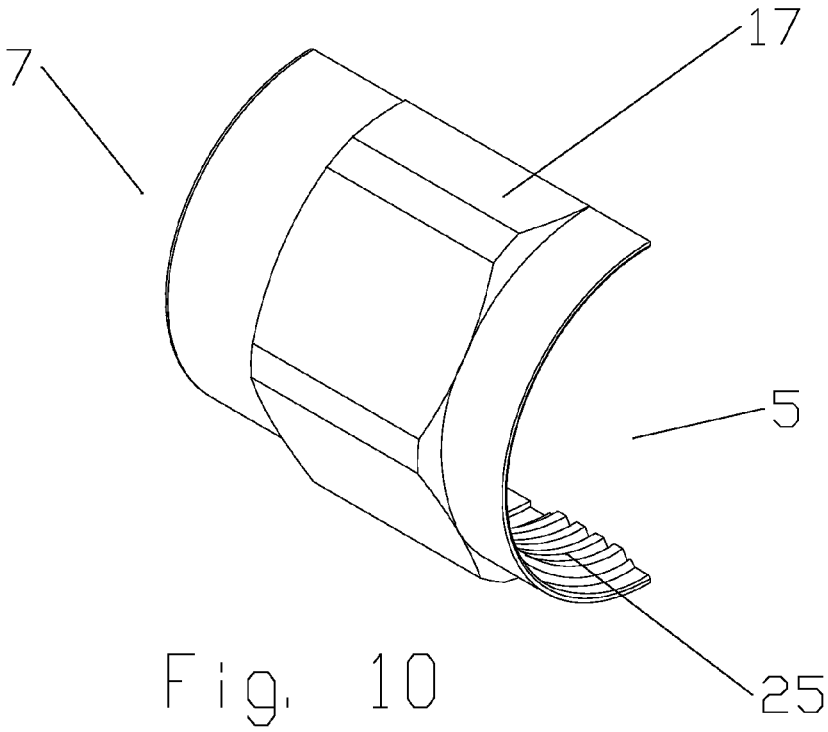
FIG. 10 is a schematic isometric cross-section outer view of the stabilizing body of FIG. 2.
Figure 11:
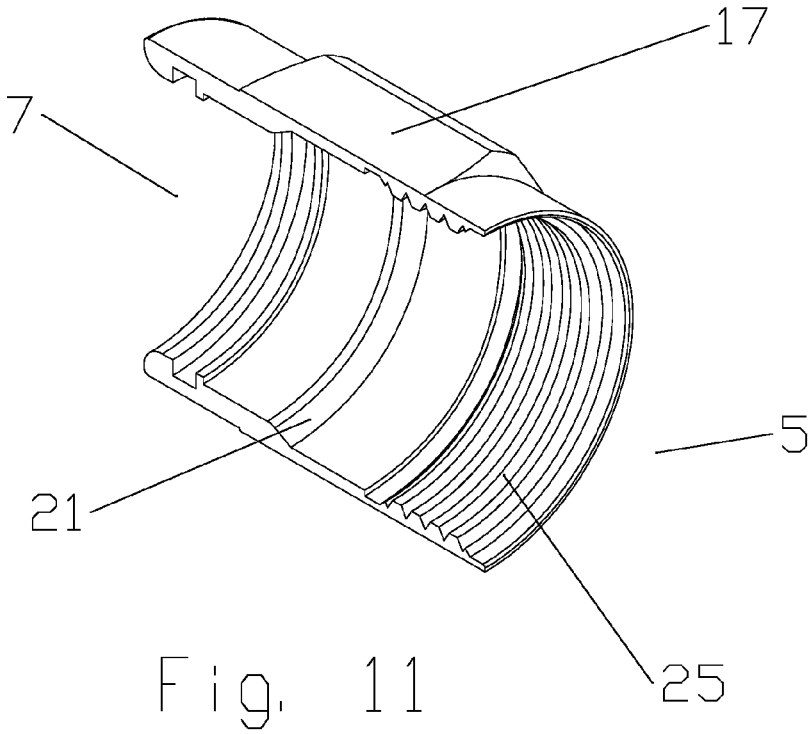
FIG. 11 is a schematic isometric cross-section inner view of the stabilizing body of FIG. 2.
Figure 12:
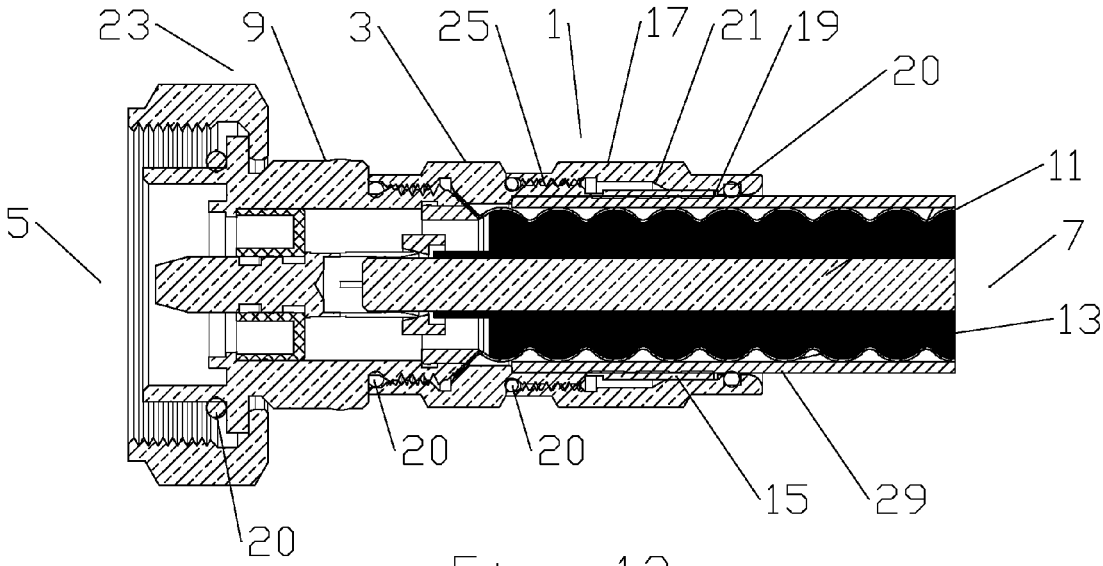
FIG. 12 is a schematic side view of an exemplary embodiment of a coupling body assembly shown mated with a coaxial connector, installed upon a portion of corrugated outer conductor coaxial cable and final longitudinal advance of the stabilizing body upon the coupling body completed.

The stabilizing body 17 is best shown in FIGS. 10 and 11. A distal end of the grip fingers 15 has a contact surface 19 that engages an inner diameter annular wedge surface 21 of a bore of the stabilizing body 17 as the stabilizing body 17 is advanced longitudinally towards the coupling body 3. The wedge surface 21 is provided with a taper between a maximum diameter of the wedge surface 21 proximate a connector end 5 of the wedge surface 21 and a minimum diameter of the wedge surface 21 proximate a cable end 7 of the wedge surface 21.

As the stabilizing body 17 is advanced axially towards the coupling body 3, for example via threads 25 or alternatively via an axial compression interference fit, the contact surface 19 of the grip fingers 15 contacts the wedge surface 21 of the stabilizing body 17, driving the grip fingers 15 radially inward against the jacket 29 and/or outer conductor 11 of the coaxial cable 13. As the inner diameter of the grip fingers 15 engage the jacket 29 and/or outer conductor 11, a secure stabilizing contact is established, distributed circumferentially around the jacket and/or outer conductor 11 and across a length of the grip fingers 15, between the coupling body assembly 1 and the attached coaxial connector body 9.

One skilled in the art will appreciate that the coupling body assembly 1 may be applied to solid outer conductor coaxial cable provided in either smooth or corrugated outer conductor 11. As shown for example in FIG. 12, by applying a length of the grip fingers 15, for example at least as wide as a corrugation period of the outer conductor 11 of a desired coaxial cable, chances of coaxial cable deformation resulting from the stabilizing contact are reduced. Because the grip fingers 15 are formed from a non-compressible material and the contacts between the grip fingers 15 and/or outer conductor 11 and the coupling body 3 and stabilizing body 17 are hard points, once the polymeric jacket 29 has deformed, if applicable, from contact therewith, the stabilizing contact is essentially rigid.

The stabilizing contact may be enhanced with respect to a longitudinal axis direction to also improve a coaxial connector to coaxial cable interconnection mechanical tear off strength, by applying a plurality of inward projecting protrusion(s) 27 to the inner diameter of the grip fingers 15. Further, the inward projecting protrusion(s) 27 may improve a coaxial connector to coaxial cable anti-rotation characteristic of the stabilizing contact and thereby of the coaxial connector to coaxial cable interconnection.

One skilled in the art will appreciate that the coupling body is outside of the electrical path of the cable to connector interconnection. Therefore, the coupling body 3 and stabilizing body 17 may be formed via conventional machining procedures formed from a metal alloy or polymeric material and/or cost efficiently manufactured via injection molding, for example of polymeric material and/or a metal injection molding metal alloy according to desired manufacturing cost and/or resulting strength characteristics. Alternatively, the coupling body 3 may be formed via metal machining to provide maximum clamping strength between the coupling body 3 and the connector body 9, while the stabilizing body 17 is formed via injection molding of a polymeric material.

Figure 4:
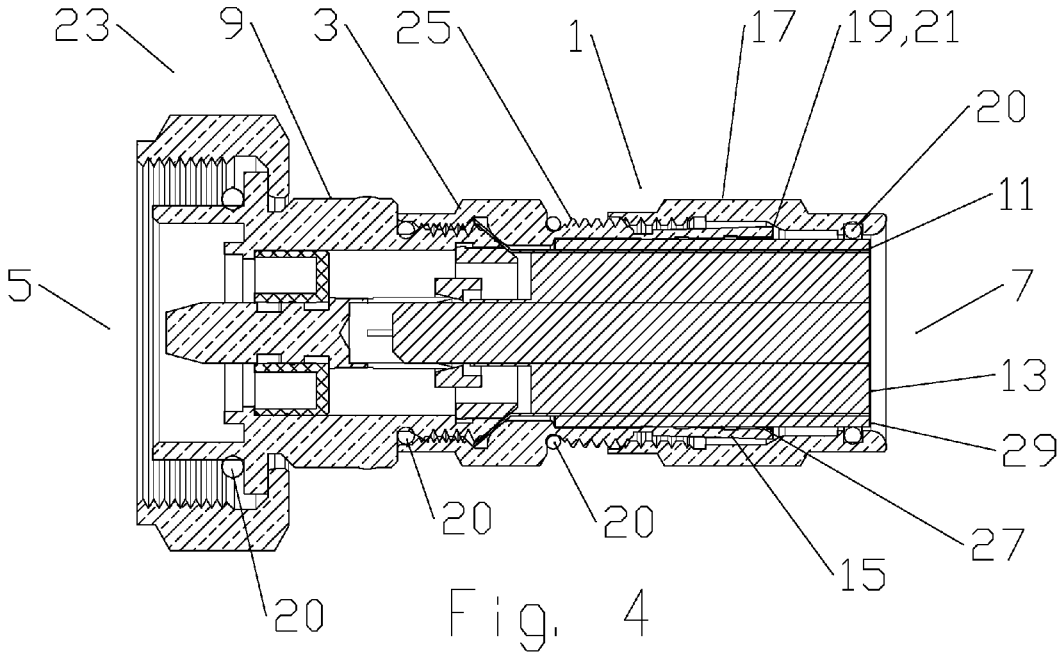
FIG. 4 is a schematic cross-section side view taken along line A-A of FIG. 5.
Figure 5:
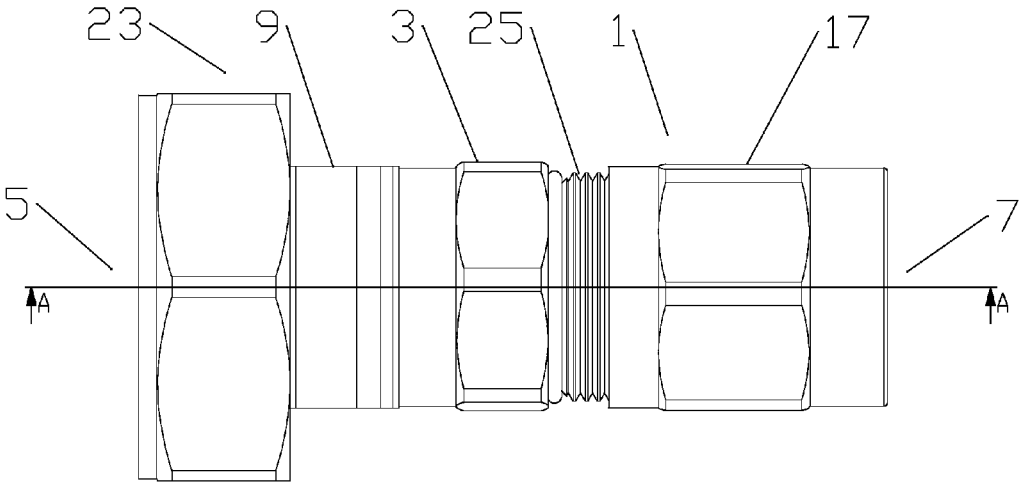
FIG. 5 is a schematic side view of an exemplary embodiment of a coupling body assembly shown mated with a coaxial connector, installed upon a portion of smooth sidewall outer conductor coaxial cable prior to final longitudinal advance of the stabilizing body upon the coupling body.
Figure 6:
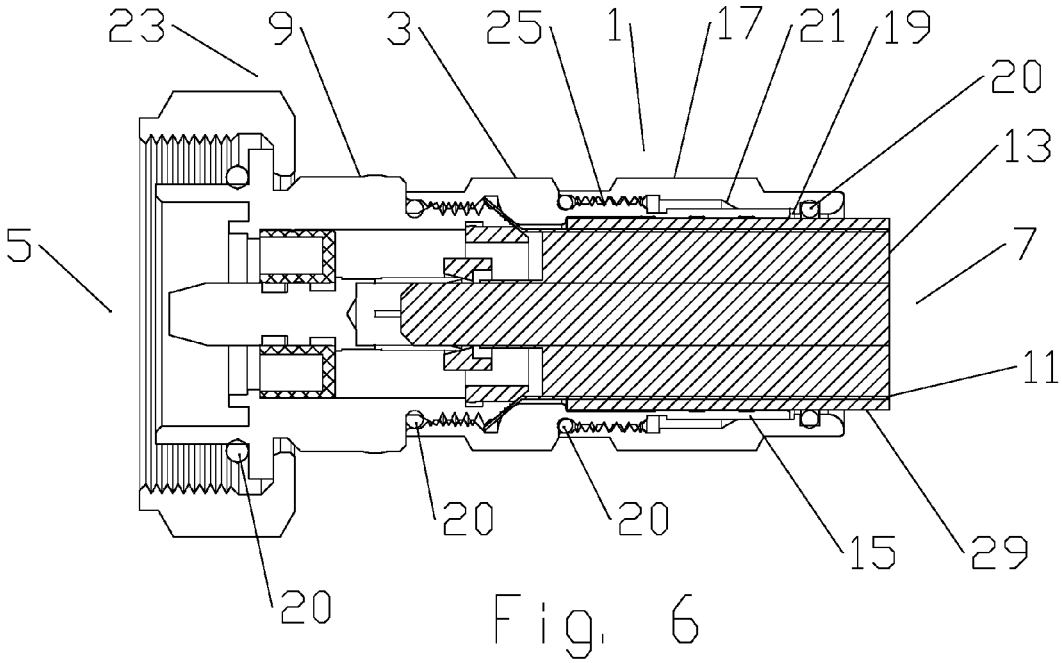
FIG. 6 is a schematic cross-section side view taken along line A-A of FIG. 7.
Figure 7:
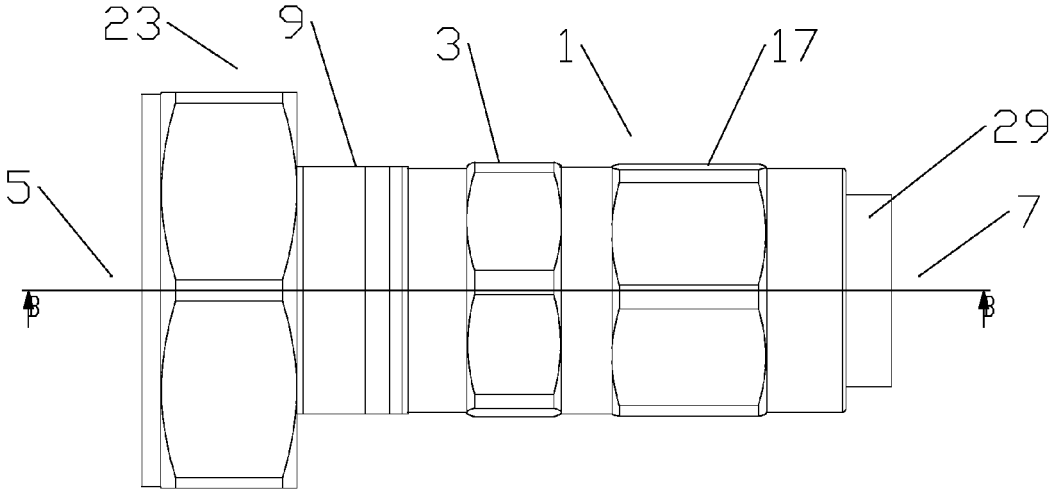
FIG. 7 is a schematic side view of an exemplary embodiment of a coupling body assembly shown mated with a coaxial connector, installed upon a portion of smooth sidewall outer conductor coaxial cable and final longitudinal advance of the stabilizing body upon the coupling body completed.

In use, the coaxial connector is interconnected with the coaxial cable according to the selected electro-mechanical configuration of the coaxial connector body 9 and connector end 5 of the coupling body 3, for example as shown in FIGS. 4 and 5. Once the electro-mechanical interconnection is completed, the connector end 5 of the stabilizing body 17 is advanced towards the cable end 7 of the coupling body 3, in the present example by threading the threads 25 together, driving the jacket grip 15 radially inward into stabilizing contact with the jacket 29, as shown in FIGS. 6 and 7. Alternatively, the stabilizing contact may be applied prior to the electro-mechanical interconnection, for example to retain the coupling body 3 and coaxial cable 13 together during flaring of the leading edge of the outer conductor 11 either manually or as a result of interconnection of the coupling body 3 and the connector body 9.

One skilled in the art will appreciate the manufacturing, installation and interconnection stabilizing benefits of the invention. Significantly, the stabilizing contact with the coaxial cable is obtained with minimal additional cost via the modifications to the cable end 7 of the coupling body 3 to add the grip fingers 15 and the addition of only one additional element, the stabilizing body.

Further, because the coupling body assembly 1 is separate from the coaxial connector body 9, benefits of the invention may be applied to existing connector families by applying the coupling body assembly 1 in place of the original coupling body configuration. Thereby, only minimal redesign of the connector end 5 of the coupling body 3 is required to mate the coupling body assembly 1 with any specific coaxial connector body 9 to obtain the benefits of the coupling body assembly 1 with a wide range of different coaxial connector 23 configurations.

| Table of Parts | |
|---|---|
| 1 | coupling body assembly |
| 3 | coupling body |
| 5 | connector end |
| 7 | cable end |
| 9 | coaxial connector body |
| 11 | outer conductor |
| 13 | coaxial cable |
| 15 | grip finger |
| 17 | stabilizing body |
| 19 | contact surface |
| 20 | sealing gasket |
| 21 | wedge surface |
| 23 | coaxial connector |
| 25 | threads |
| 27 | protrusion |
| 29 | jacket |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A stabilizing coupling body assembly for a coaxial connector, comprising:

a monolithic coupling body dimensioned to couple at a connector end of the coupling body with a cable end of a coaxial connector body of the coaxial connector;

a plurality of grip fingers extending from a cable end of the coupling body, the grip fingers dimensioned for insertion within a bore of a stabilizing body;

the stabilizing body coupled to a cable end of the coupling body;

a distal end of the grip fingers dimensioned to engage an annular wedge surface of the bore of the stabilizing body;

the wedge surface provided with a taper between a maximum diameter proximate a connector end of the wedge surface and a minimum diameter proximate a cable end of the wedge surface; whereby the distal end of the grip fingers contact and are driven radially inward by the wedge surface as the stabilizing body is advanced axially towards the coupling body.

2. The assembly of claim 1, wherein an inner diameter of the grip fingers is provided with a plurality of inward projecting protrusions.

3. The assembly of claim 1, wherein the grip fingers are distributed circumferentially around a coupling body bore of the coupling body.

4. The assembly of claim 1, wherein a length of the grip fingers is at least as long as a corrugation period of an outer conductor of a desired coaxial cable.

5. The assembly of claim 1, further including a sealing gasket seated on an outer diameter of the coupling body, axially positioned to seal against an inner diameter of the stabilizing body when the stabilizing body is in a coupled position upon the coupling body.

6. The assembly of claim 1, wherein the stabilizing body is coupled to the coupling body via threads.

7. The assembly of claim 6, wherein the threads are provided on an outer diameter of the coupling body and an inner diameter of the stabilizing body.

8. A method for manufacturing a stabilizing coupling body assembly for a coaxial connector, comprising the steps of:

forming a monolithic coupling body dimensioned to couple at a connector end of the coupling body with a cable end of a coaxial connector body of the connector;

a plurality of grip fingers extending from a cable end of the coupling body, the grip fingers dimensioned for insertion within a bore of a stabilizing body;

forming the stabilizing body dimensioned to couple to a cable end of the coupling body;

a distal end of the grip fingers proximate an annular wedge surface of the bore of the stabilizing body;

the wedge surface provided with a taper between a maximum diameter proximate a connector end of the wedge surface and a minimum diameter proximate a cable end of the wedge surface; whereby the grip fingers are driven radially inward as the stabilizing body is advanced axially towards the coupling body.

9. The method of claim 8, wherein the coupling body is formed by injection molding.

10. The method of claim 8, wherein the stabilizing body is formed by injection molding.

11. The method of claim 8, wherein the coupling body is formed of a polymeric material.

12. The method of claim 8, wherein the coupling body is formed of a metal alloy.

13. The method of claim 8, wherein the stabilizinb body is formed of a polymeric material.

14. The method of claim 8, wherein the stabilizing body is formed of a polymeric material.

15. The method of claim 8, wherein the coupling body and the stabilizing body are each formed with corresponding threads.

16. The method of claim 8, wherein a length of the grip fingers is at least as long as a corrugation period of an outer conductor of a desired coaxial cable.

17. A stabilizing coupling body assembly for a coaxial connector, comprising:

a monolithic coupling body dimensioned to couple at a connector end of the coupling body with a cable end of a coaxial connector body of the coaxial connector;

a plurality of grip fingers, distributed circumferentially around a bore of the coupling body, extending from a cable end of the coupling body, the grip fingers dimensioned for insertion within a bore of a stabilizing body;

the stabilizing body coupled to a cable end of the coupling body via threads;

a distal end of the grip fingers dimensioned to engage an annular wedge surface of the bore of the stabilizing body;

an inner diameter of the grip fingers is provided with a plurality of inward projecting protrusions;

a sealing gasket seated on an outer diameter of the coupling body, axially positioned to seal against an inner diameter of the stabilizing body when the stabilizing body is in a coupled position upon the coupling body;

the wedge surface provided with a taper between a maximum diameter proximate a connector end of the wedge surface and a minimum diameter proximate a cable end of the wedge surface; whereby the distal end of the grip fingers contact and are driven radially inward by the wedge surface as the stabilizing body is advanced axially towards the coupling body.

18. The assembly of claim 17, wherein a length of the grip fingers is at least as long as a corrugation period of an outer conductor of a desired coaxial cable.

* * * * *